US009815270B2

(12) United States Patent
Saito et al.

(10) Patent No.: US 9,815,270 B2
(45) Date of Patent: Nov. 14, 2017

(54) INTERMEDIATE TRANSFER MEMBER, METHOD OF MANUFACTURING THE SAME, AND IMAGE FORMING METHOD

(71) Applicant: CANON KABUSHIKI KAISHA, Tokyo (JP)

(72) Inventors: Yoshikazu Saito, Inagi (JP); Mitsutoshi Noguchi, Kawaguchi (JP); Takumi Suzuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/173,978

(22) Filed: Jun. 6, 2016

(65) Prior Publication Data

US 2016/0368263 A1 Dec. 22, 2016

(30) Foreign Application Priority Data

Jun. 16, 2015 (JP) ..... 2015-121135

(51) Int. Cl.
*B41J 2/005* (2006.01)
*B41J 2/01* (2006.01)
*B05D 3/00* (2006.01)

(52) U.S. Cl.
CPC ..... *B41J 2/0057* (2013.01); *B05D 3/007* (2013.01); *B41J 2/01* (2013.01); *B41J 2002/012* (2013.01)

(58) Field of Classification Search
CPC ..... B41J 2/0057; B41J 2/01; B41J 2002/012; B05D 3/007
See application file for complete search history.

(56) References Cited

U.S. PATENT DOCUMENTS 4,538,156 A 8/1985 Durkee et al.
6,422,696 B1 * 7/2002 Takahashi ..... B41J 2/01 347/103

(Continued)

FOREIGN PATENT DOCUMENTS

EP 2813365 A1 12/2014
JP 59-225958 A 12/1984

(Continued)

OTHER PUBLICATIONS

U.S. Appl. No. 15/143,936, filed May 2, 2016, Noguchi.
Extended European Search Report in European Application No. 16001292.8 (Oct. 31, 2016).

*Primary Examiner* — Sharon A Polk
(74) *Attorney, Agent, or Firm* — Fitzpatrick, Cella, Harper & Scinto

(57) ABSTRACT

Provided an intermediate transfer member for use in an image forming method including: (1) applying a liquid for reducing fluidity of ink onto the intermediate transfer member; (2) forming an image by applying the ink onto the intermediate transfer member on which the liquid for reducing the fluidity of the ink is applied; and (3) transferring the image onto a recording medium, the intermediate transfer member including: a base; and an elastic layer formed on the base, the elastic layer including: a stack of a first layer being an outer layer and having a plurality of protrusions formed on a surface thereof; and a second layer located below the first layer, an elastic modulus (E1) [MPa] of the first layer and an elastic modulus (E2) [MPa] of the second layer satisfying a relationship of (E1−E2)≥5 [MPa].

9 Claims, 3 Drawing Sheets

(56) References Cited

U.S. PATENT DOCUMENTS

| | | | |
|---|---|---|---|
| 8,783,852 | B2 | 7/2014 | Noguchi |
| 8,871,337 | B2 | 10/2014 | Kushida et al. |
| 9,067,449 | B2 | 6/2015 | Morita et al. |
| 9,354,557 | B2 | 5/2016 | Noguchi |
| 2011/0234729 | A1 | 9/2011 | Noguchi |
| 2014/0368592 | A1 | 12/2014 | Morita et al. |
| 2016/0246216 | A1 | 8/2016 | Noguchi |

FOREIGN PATENT DOCUMENTS

| | | | |
|---|---|---|---|
| JP | 7-017030 | A | 1/1995 |
| WO | 2012/014427 | A1 | 2/2012 |

* cited by examiner

INTERMEDIATE TRANSFER MEMBER, METHOD OF MANUFACTURING THE SAME, AND IMAGE FORMING METHOD

BACKGROUND OF THE INVENTION

Field of the Invention

The present invention relates to an intermediate transfer member, a method of manufacturing an intermediate transfer member, and to an image forming method.

Description of the Related Art

In recent years, an image forming method and an image forming apparatus using an ink jet system have been attracting attention as technologies suited to meet market demands for a shift to wide-variety small-lot production of printed matter and reduction in delivery time. However, the image formation using the ink jet system may cause a phenomenon that adjacent dots of applied ink are mixed with each other (bleeding) or a phenomenon that ink landed first is attracted by ink landed later (beading). Further, the image formation using the ink jet system may cause a curling phenomenon or a cockling phenomenon due to excessive absorption of a liquid component of ink by a recording medium.

To prevent those phenomena, there is proposed an image recording method that involves transferring, onto a recording medium, an intermediate image formed by applying ink onto an intermediate transfer member, to thereby obtain an image (transfer-type ink jet recording method). In Japanese Patent Application Laid-Open No. S59-225958, there is proposed an ink jet printer configured to form an image on a drum with dye ink and transfer the image onto a recording medium.

For the purpose of keeping the formed image satisfactorily by preventing the flow of ink applied onto the surface of the intermediate transfer member, there are many proposals that a treatment solution for reducing the fluidity of the ink be applied onto the intermediate transfer member before the ink image is formed.

It is preferred that the surface of the intermediate transfer member for use in the transfer-type ink jet recording method be formed of an elastic body so as to secure the uniformity of a pressure to be applied when an image is transferred onto a recording medium. It is also preferred that the intermediate transfer member have low surface free energy from the viewpoint of image transfer efficiency.

However, the intermediate transfer member having low surface free energy is liable to cause a phenomenon that the treatment solution is repelled or inwardly attracted due to surface tension of the treatment solution, thereby degrading the quality of the ink image formed afterwards. In general, such a phenomenon is liable to occur as the intermediate transfer member becomes smoother with lower surface roughness.

In Japanese Patent Application Laid-Open No. H07-017030, there is proposed that a fine uneven shape be formed on the surface of the intermediate transfer member formed of an elastic body made of silicone rubber or other materials, to thereby prevent the above-mentioned image degradation phenomenon that may be caused by the repellence or inward attraction of the treatment solution. As a method of manufacturing the intermediate transfer member having an uneven shape formed on its surface, in Japanese Patent Application Laid-Open No. H07-017030, there is proposed a forming method using a mold having a desired fine uneven shape.

In particular, there is given an embossing method using a mold generally referred to as "embossing roll", which has an inverted shape of a desired uneven shape on the cylindrical peripheral surface. In this method, the embossing roll is brought into press contact with the surface of the elastic body to impart the uneven shape successively. Thus, this method is suited in terms of dimensional accuracy of the uneven shape and productivity.

It is preferred that the elastic body to be used for the surface of the intermediate transfer member be low in elastic modulus and easily deformable by pressure so as to secure the uniformity of the pressure with ease when an image is transferred onto a recording medium. In particular, the image transfer rate for a recording medium is liable to decrease when the image is transferred onto a recording medium having a rough surface or the transfer time is short. Therefore, the elastic body is required to have a particularly low elastic modulus.

SUMMARY OF THE INVENTION

According to an aspect of the present invention, there is provided an intermediate transfer member for use in an image forming method, the image forming method including:

(1) applying a liquid for reducing fluidity of ink onto the intermediate transfer member;

(2) forming an intermediate image by applying the ink onto the intermediate transfer member on which the liquid for reducing the fluidity of the ink is applied; and (3) transferring the intermediate image onto a recording medium, the intermediate transfer member including:

a base; and an elastic layer formed on the base, the elastic layer including:

a first layer being an outermost layer and having a plurality of protrusions formed on a surface of the first layer; and a second layer located below the first layer, an elastic modulus (E1) [MPa] of the first layer and an elastic modulus (E2) [MPa] of the second layer satisfying a relationship of $(E1-E2)\geq 5$ [MPa].

Further, according to another aspect of the present invention, there is provided an image forming method, including:

(1) applying a liquid for reducing fluidity of ink onto the above-mentioned intermediate transfer member;

(2) forming an intermediate image by applying the ink onto the intermediate transfer member on which the liquid for reducing the fluidity of the ink is applied; and (3) transferring the intermediate image onto a recording medium.

Further, according to still another aspect of the present invention, there is provided a method of manufacturing the above-mentioned intermediate transfer member, the method including:

forming a second layer of an elastic layer by applying a material for forming the second layer of the elastic layer on a base and curing the applied material for forming the second layer; and forming a first layer of the elastic layer by applying a material for forming the first layer of the elastic layer on the second layer and forming a plurality of protrusions on a surface of the applied material for forming the first layer.

According to the present invention, it is possible to provide the intermediate transfer member, which is capable of securing both the accuracy of the uneven shape and the transferability of the image, and to provide the image forming method using the intermediate transfer member.

According to the present invention, it is possible to provide the method of manufacturing an intermediate transfer member, which is capable of suppressing the fluctuation of the film thickness of the elastic body of the intermediate transfer member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

When embossing is carried out for a material having low elastic modulus, such as rubber, it is difficult to accurately transfer an uneven shape of a mold onto the surface of a transfer member, with the result that the height of the uneven shape may become smaller than that of the desired shape or the corners may be rounded. In particular, as the dimensions of the uneven shape are smaller, it is more difficult to accurately impart the shape onto an elastic body having low elastic modulus.

When a material having high elastic modulus is used, on the other hand, it is possible to more accurately impart the uneven shape by embossing. However, it is difficult to secure the uniformity of the pressure when the transfer member transfers an image onto a recording medium as an intermediate transfer member. Therefore, the problem of degradation in transferability is not addressed.

In view of the above, the present invention has an object to provide an intermediate transfer member, which is capable of securing both the accuracy of the uneven shape and the transferability of the image, and to provide an image forming method using the intermediate transfer member.

To secure the uniformity of the pressure at the time of transfer, the elastic body needs to have a certain degree of film thickness, and the film thickness needs to be uniform. When embossing is carried out for the elastic body, however, the elastic body may fluctuate in film thickness due to pressurization by the embossing roll. Particularly when the surface area of the intermediate transfer member is wide, it is more difficult to control the uniformity of the film thickness in the surface.

In view of the above, the present invention has another object to provide a method of manufacturing an intermediate transfer member, which is capable of suppressing the fluctuation of the film thickness of the elastic body of the intermediate transfer member.

An embodiment of the present invention relates to an intermediate transfer member for use in the following image forming method.

Specifically, there is provided an image forming method, including:

(1) applying a liquid for reducing fluidity of ink onto the intermediate transfer member;

(2) forming an intermediate image by applying the ink onto the intermediate transfer member on which the liquid for reducing the fluidity of the ink is applied; and (3) transferring the intermediate image onto a recording medium.

Now, the image forming method and the intermediate transfer member according to this embodiment are described by way of specific examples. In the following description, the "liquid for reducing the fluidity of the ink" is also referred to as "treatment solution".

[Image Forming Apparatus]

Figure 1:
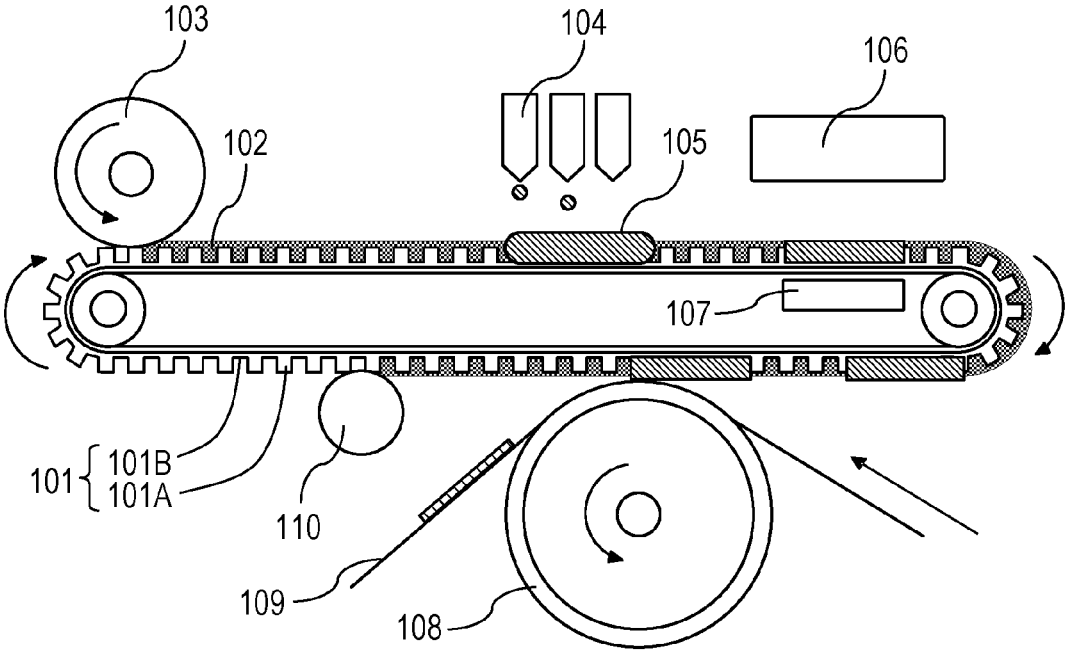
FIG. 1 is a schematic view of an image forming apparatus to which the present invention is applicable.

FIG. 1 is a schematic view of the overall structure of an image forming apparatus using the intermediate transfer member according to this embodiment.

In FIG. 1, an intermediate transfer member 101 having a plurality of fine protrusions 101A formed on its surface is disposed on the outer surface of an endless belt-like rotatable support member. The intermediate transfer member 101 is driven to rotate in the arrow direction, and mechanisms disposed on the periphery are actuated in synchronization with the rotation. The intermediate transfer member 101 may have any shape as long as the surface of the intermediate transfer member 101 may be brought into contact with a recording medium 109. For example, a roller-like or drum-like intermediate transfer member may be used suitably depending on the type of the image forming apparatus to which the intermediate transfer member is applied or the method of transferring an image onto the recording medium.

In particular, through use of the intermediate transfer member disposed on the outer surface of the endless belt-like support member as in the embodiment of FIG. 1 or the drum-like support member, the same intermediate transfer member can be used successively and repeatedly, thereby being extremely suited in terms of productivity. The support member may also serve as a base for the intermediate transfer member to be described later.

[Image Forming Method]

An overview of the image forming method according to this embodiment is described.

First, image data is transmitted from an image supply apparatus (not shown) and image formation is instructed. Then, image processing required to carry out the image formation through use of an ink jet recording head 104 is carried out for the image data. Then, the rotation of the intermediate transfer member 101 is started.

Subsequently, a treatment solution 102 for reducing the fluidity of ink is applied onto the surface of the intermediate transfer member 101 by a roll coater 103. As a unit configured to apply the treatment solution 102, any related-art application units such as a spray coater and a bar coater as well as the roll coater may be used suitably. The applied treatment solution 102 enters recesses 101B each formed between the fine protrusions 101A on the surface of the intermediate transfer member to wet and spread over the surface of the intermediate transfer member 101 into a film. The wetting and spreading state of the treatment solution 102 may be observed through use of, for example, an optical microscope.

The amount of applying the treatment solution 102 onto the intermediate transfer member is desirably 0.05 $g/m^2$ or more and 5.0 $g/m^2$ or less. When the application amount is 0.05 $g/m^2$ or more, the fluidity of the ink can be reduced sufficiently. When the application amount is 5.0 $g/m^2$ or less, a surplus treatment solution can be prevented from spilling out of or overflowing the recesses 101B to cause image disturbance or transfer failure.

In a subsequent step, ink for image formation is selectively applied, through use of the ink jet recording head 104, onto the surface of the intermediate transfer member 101 on which the treatment solution 102 is applied, to thereby form an intermediate image 105. At this time, the applied ink is brought into contact with the treatment solution 102 on the surface of the intermediate transfer member 101 to chemically and/or physically react with the treatment solution 102 so that the fluidity is reduced. As a result, the phenomenon that the ink dots attract or mix with each other unintendedly is suppressed.

In a subsequent step, a liquid component is removed from the formed intermediate image. When the liquid component is excessively contained in the intermediate image formed on the intermediate transfer member 101, a surplus liquid may spill out or overflow in a subsequent transfer step to cause image disturbance or transfer failure.

As a method of removing the liquid component, any various related-art methods may be applied suitably. There may suitably be used any of a method involving heating, a method involving blowing low-humidity air, a method involving depressurization, a method involving contact of an absorbent, and a method using the above-mentioned methods in combination. Alternatively, natural drying may be used for removing the liquid component. In the apparatus exemplified in FIG. 1, an air blower 106 is disposed. A heater 107 configured to heat the intermediate transfer member 101 from the back side is disposed as well.

In a subsequent step, the recording medium 109 is brought into press contact with the intermediate transfer member 101 to transfer the intermediate image onto the recording medium 109. In the apparatus exemplified in FIG. 1, the intermediate transfer member 101 and the recording medium 109 are pressurized through use of a pressure roller 108 to transfer the intermediate image. For the purpose of increasing the transfer rate of the intermediate image to be transferred onto the recording medium 109, the pressure roller 108 and the intermediate transfer member 101 may be heated. The upper limit of preferred heating temperature at the time of heating the pressure roller 108 and the intermediate transfer member 101 is 200° C. When the temperature falls within a range of 200° C. or less, degradation of the ink component and damage to the intermediate transfer member 101 can be suppressed.

The intermediate transfer member 101 may be used repeatedly and successively from the viewpoint of productivity. In this case, it is preferred that the surface be cleaned and refreshed before the intermediate image is formed next time. As a cleaning and refreshing method, any various related-art methods may be applied suitably. There may suitably be used any of a method involving showering a cleaning solution, a method involving wiping through abutment of a wetted molleton roller against the surface, a method involving contact with the surface of the cleaning solution, a method involving scraping through use of a wiper blade, a method involving applying various types of energy, and other methods. As a matter of course, a method using a plurality of the above-mentioned methods in combination is also suitable. In the apparatus exemplified in FIG. 1, a molleton roller 110 is disposed so as to remove, for example, ink components or paper dust remaining on the surface of the belt-like intermediate transfer member 101 after the transfer.

When the processing for the image data transmitted from the image supply apparatus is finished as described above, the image formation procedure is finished. As an additional step, the recording medium having the transfer image formed thereon may be pressurized by a fixing roller to enhance the surface smoothness of the image. At this time, the fixing roller may be heated to impart fastness properties to the image.

[Intermediate Transfer Member]

Next, the intermediate transfer member according to this embodiment is described in detail. The intermediate transfer member according to this embodiment includes a base and an elastic layer formed on the base. The elastic layer has a structure including a first layer corresponding to an outermost layer and having a plurality of protrusions formed on the surface of the first layer, and a second layer located below the first layer.

Figure 2:
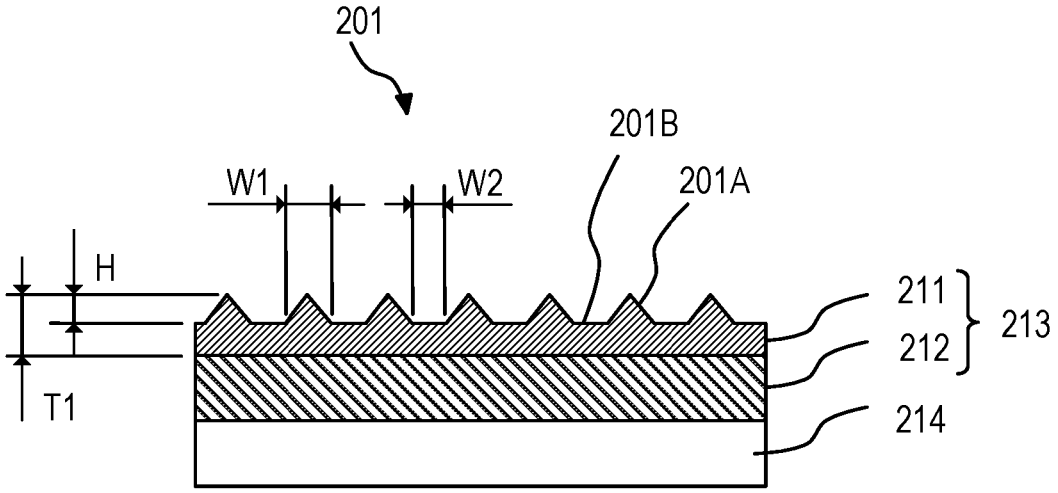
FIG. 2 is a schematic sectional view of the layer structure of an intermediate transfer member to which the present invention is applicable.

FIG. 2 is a schematic sectional view of the layer structure of the intermediate transfer member according to this embodiment. An intermediate transfer member 201 includes a plurality of stacked layers. Specifically, a first layer 211 corresponding to an outermost layer and a second layer 212 located below the first layer 211 are formed on a base 214 as an elastic layer 213. Further, the first layer 211 has a fine protruding shape (hereinafter referred to as "protrusion") 201A formed on its surface. Moreover, a fine recessed shape (hereinafter referred to as "recess") 201B is present between adjacent protrusions 201A. When the elastic modulus of the first layer 211 is represented by E1 [MPa] and the elastic modulus of the second layer 212 is represented by E2 [MPa], the elastic moduli satisfy a relationship of $(E1-E2)\geq 5$ [MPa]. The elastic moduli preferably satisfy a relationship of $(E1-E2)\geq 10$ [MPa]. Each of the elastic moduli is a compressive elastic modulus measurable through use of a microhardness tester or other testers.

The elastic modulus E1 is preferably 8 MPa or more and 40 MPa or less. The elastic modulus E2 is preferably 0.1 MPa or more and less than 8 MPa. When the elastic modulus E1 is 8 MPa or more, the accuracy of imparting the uneven shape by embossing is enhanced. When the elastic modulus E1 is 40 MPa or less, the surface of the intermediate transfer member is not excessively hard, thereby being capable of suppressing influence on securing the uniformity of the pressure at the time of transfer. When the elastic modulus E2 is 0.1 MPa or more, the uniformity of the film thickness of the elastic layer after embossing can be maintained. When the elastic modulus E2 is less than 8 MPa, the uniformity of the pressure at the time of transfer can be achieved. The elastic modulus E1 is more preferably 8 MPa or more and 20 MPa or less, whereas the elastic modulus E2 is more preferably 0.5 MPa or more and less than 8 MPa.

When the intermediate image formed on the surface of the intermediate transfer member is transferred onto a recording medium such as paper, the intermediate transfer member is brought into press contact with the surface of the recording medium. To uniformly distribute the pressure applied at this time so as to enhance the transferability of the intermediate image, it is desired that the elastic layer be deformed in conformity with the shape of the surface of the recording medium. In the intermediate transfer member 201 according to this embodiment, the elastic layer 213 includes the second layer 212 having low elastic modulus, and is therefore deformable flexibly so that the elastic layer 213 may conform to the shape of the surface of the recording medium.

In particular, a film thickness T1 of the first layer 211 is preferably 100 μm or less, more preferably 0.1 μm or more and 100 μm or less. When the film thickness T1 is 100 μm or less, the second layer 212 having low elastic modulus conforms to the shape of the surface of the recording medium more easily. As a result, an image having high transfer rate is obtained even when the image is transferred onto a recording medium having a rough surface or the transfer time is short.

The fine protrusions 201A formed on the surface of the first layer 211 have an effect of suppressing repellence of the treatment solution when the treatment solution is applied, thereby maintaining a state in which the treatment solution spreads into a film. The shape of each protrusion 201A in vertical cross section may be a rectangular shape, a triangular shape, a dome shape, or any other shape. A greater effect is obtained as the dimensions of each protrusion are smaller and the number of protrusions is larger, thereby suppressing the repellence of the treatment solution even when a treatment solution having high surface tension is applied or the application amount of the treatment solution is small. Specifically, when the average height of the protruding shape is represented by H and the average base width of the protruding shape is represented by W1, the dimensions of each protrusion 201A are preferably 0.05 μm≤H≤1.0 μm and W1≤1.0 μm. The dimensions of each protrusion 201A are more preferably 0.1 μm≤H≤0.5 μm and W1≤0.3 μm. The dimensions of each protrusion 201A are still more preferably 0.1 μm≤H≤0.5 μm and 0.01 μm≤W1≤0.3 μm.

As a method of forming the protrusions 201A as described above, embossing is suitable. In the embossing, curing is carried out while imparting a pattern onto an uncured elastic material. In the intermediate transfer member 201 according to this embodiment, the protrusions 201A are mainly imparted onto the single first layer 211 having high elastic modulus. Thus, the pattern formed on the peripheral surface of the embossing roll can be transferred accurately, thereby suppressing the problem in that the height of each protrusion becomes smaller than that of the pattern formed on the embossing roll or the corners are rounded. In particular, the protrusions can be formed accurately even when the dimensions of each protrusion are small as described above.

From the viewpoint of efficiency of image transfer from the intermediate transfer member onto the recording medium, it is preferred that the intermediate transfer member have low surface free energy. To reduce the surface free energy, the surface of the intermediate transfer member may be formed of an elastic body having dimethylsiloxane structure or fluoroalkyl structure. Examples of the material suited to the elastic body as described above include silicone rubber and fluororubber.

Next, the method of manufacturing an intermediate transfer member according to this embodiment is described in detail.

Figure 3:
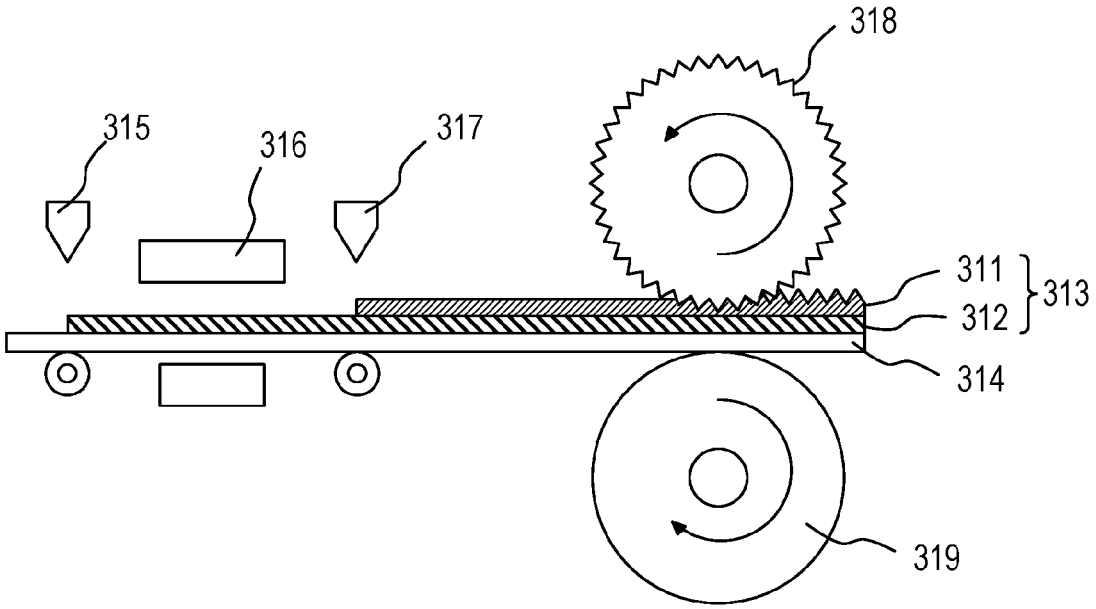
FIG. 3 is a schematic view of an apparatus and process for manufacturing an intermediate transfer member to which the present invention is applicable.

FIG. 3 is a schematic view of the method of manufacturing an intermediate transfer member according to this embodiment.

In FIG. 3, the respective steps are carried out for a belt-like base successively from the viewpoint of productivity, but the present invention is not limited thereto. The respective steps may be carried out individually to manufacture the intermediate transfer member.

A second layer 312 of an elastic layer 313 is formed on a base 314. To form the second layer 312, a material for forming the second layer is first applied onto the base 314. As an application unit, any related-art application units such as a die coater, a roll coater, a spray coater, and a bar coater may be applied. An example of using a die coater 315 suited in this case is described because the die coater 315 is capable of controlling the film thickness with high accuracy. The film thickness of the second layer 312 preferably falls within a range of from 10 μm to 1 mm. When the film thickness of the second layer 312 is 10 μm or more, the elastic layer 313 can sufficiently be brought into close contact with the recording medium in the image transfer step, thereby being capable of suppressing transfer failure. When the film thickness of the second layer 312 is 1 mm or less, the deformation amount with respect to the pressure is not excessively large in the image transfer step, thereby being capable of suppressing disturbance of the transferred image.

Subsequently, the material for forming the second layer is cured to form the second layer. When a thermosetting or UV-curable material is used as the material for forming the second layer, the material may be cured by heating or UV irradiation. In FIG. 3, a curing apparatus 316 is provided for the formation of the second layer.

Subsequently, a material for forming a first layer of the elastic layer is applied. As an application method, the same method as that for the second layer 312 may be applied. A die coater 317 is also used in this case. For the purpose of enhancing the close contact between the first layer and the second layer, activation treatment, such as plasma treatment, corona treatment, or UV ozonation, or application of a primer may be carried out for the surface of the second layer before the material for forming the first layer is applied.

Subsequently, the base and the elastic layer are nipped by an embossing roll 318 and a backup roll 319 disposed at a position opposed to the embossing roll 318. In this manner, a recessed shape formed on the peripheral surface of the embossing roll is pressed against the surface of an uncured first layer 311 (surface of the applied material for forming the first layer) to form the first layer 311 having a fine protruding shape on its surface. When thermosetting or UV-curable silicone rubber is used as the material for the first layer, it is desired that a stimulus corresponding to the material, such as heat or UV rays, be applied at the same time as when the embossing roll 318 is pressed.

In this step, the elastic layer is deformed through the pressurization by the embossing roll, but the uncured elastic layer may fluctuate in film thickness due to fluctuation of the pressure or other factors. However, the second layer of the elastic layer has already been cured, and hence only the uncured first layer may fluctuate in film thickness. Therefore, the amount of fluctuation of the film thickness of the entire elastic layer, which may be caused by the embossing step, is reduced, thereby being capable of obtaining an intermediate transfer member having high dimensional accuracy.

The step of forming the first layer may include a step of bringing a mold, which has a recessed shape conforming to the protrusions to be formed on the surface of the first layer, into contact with the surface of the uncured first layer (surface of the applied material for forming the first layer).

EXAMPLES

Next, the present invention is more specifically described by way of examples of the image forming method according to the present invention. The present invention is not limited to the following examples without departing from the gist of the present invention. Note that, in the description of the amounts of components, "part(s)" and "%" are by mass unless otherwise specified.

Example 1

[Manufacture of Intermediate Transfer Member]

A manufacturing example and a structural example of the intermediate transfer member used in the present invention are described below with reference to FIG. 3.

A polyimide film serving as the base 314 (width of 330 mm) was suspended by an unrolling apparatus configured to unroll the polyimide film that was rolled up into a roll shape, and by a roll-up apparatus configured to roll up the polyimide film into a roll shape. The following manufacturing steps were carried out successively during a period from the unrolling of the polyimide film to the roll-up of the polyimide film into a roll shape.

First, a primer was applied onto the polyimide film through use of a roll coater, and then a material for forming a second layer of an elastic layer, which was obtained by kneading silicone rubber "SIM-260" (trade name) and a curing agent "CAT-260" (trade name) produced by Shin-Etsu Chemical Co., Ltd. at a mass ratio of 10:1, was applied through use of the die coater 315.

Subsequently, the applied silicone rubber was cured by heating the silicone rubber to 150° C. through use of a hot-air drying furnace as the curing apparatus 316, to thereby form the second layer 312 on the base.

Subsequently, the surface of the cured second layer 312 was treated by an atmospheric-pressure plasma apparatus (not shown), to thereby activate the surface. Then, a material for forming a first layer of the elastic layer, which was obtained by kneading silicone rubber "X-32-3094-2" (trade name) and a curing agent "CX-32-3094-2" (trade name) produced by Shin-Etsu Chemical Co., Ltd. at a mass ratio of 10:1, was applied through use of the die coater 317.

Then, the embossing roll 318 having the recessed shape formed on its peripheral surface in conformity with the predetermined protrusions to be imparted onto the elastic layer 313 was disposed at a position opposed to the backup roll 319, to thereby carry out embossing for the surface of the silicone rubber. At this time, the embossing roll 318 and the backup roll 319 were heated to 150° C. to cure the applied material for forming the first layer at the same time as the embossing, to thereby form the first layer on the second layer.

In Example 1, a pattern in which quadrangular pyramids each having the base width W1 and the height H were disposed in a square array at intervals W2 was used as the pattern of the protrusions on the surface of the intermediate transfer member.

The embossed film obtained by carrying out the above-mentioned steps successively was rolled up again into a roll shape by the roll-up apparatus. The embossed film thus rolled up was heated for 1 hour through use of a heating furnace heated to 200° C., to thereby fully cure the elastic layer. In this manner, the intermediate transfer member was completed.

The compressive elastic moduli of the respective layers of the elastic layer of the intermediate transfer member were measured through use of sample layers individually formed on rigid substrates under the conditions that a microhardness tester "FISCHERSCOPE HM2000" (trade name) manufactured by Fischer Instruments K. K. was operated at a probe indentation speed of 10 μm/sec and a probe indentation depth of 10 μm.

[Evaluation of Fine Uneven Shape]

The dimensions of the fine protrusions formed on the surface of the manufactured intermediate transfer member were measured through use of an atomic force microscope, and were evaluated in accordance with the following criteria.

A: The height of each protrusion is 90% or more of the depth of the recessed shape of the embossing roll.

B: The height of each protrusion is less than 90% and 50% or more of the depth of the recessed shape of the embossing roll.

C: The height of each protrusion is less than 50% of the depth of the recessed shape of the embossing roll.

[Evaluation of Fluctuation of Film Thickness of Elastic Layer]

The film thickness of the elastic layer of the manufactured intermediate transfer member was measured at ten locations through use of a micrometer, and was evaluated in accordance with the following criteria.

A: The fluctuation of the film thickness of the elastic layer is 20% or less.

B: The fluctuation of the film thickness of the elastic layer is more than 20% and 40% or less.

C: The fluctuation of the film thickness of the elastic layer is more than 40%.

[Evaluation of State of Applied Treatment Solution]

A treatment solution having the following composition was prepared, and was applied onto the manufactured intermediate transfer member through use of an offset gravure roll.

| | |
|---|---|
| Levulinic acid | 45 parts |
| Potassium hydroxide | 3 parts |
| Surfactant ["MEGAFACE F-444" (trade name) produced by DIC Corporation] | 10 parts |
| Resin particles ["AQUACER 531" (trade name) produced by BYK Japan KK] | 20 parts |
| Ion exchanged water | 22 parts |

The application amount of the treatment solution was controlled by the offset gravure roll, and the treatment solution was applied in three types of amounts, specifically, about 5 g/m$^2$, about 1 g/m$^2$, and about 0.5 g/m$^2$. After the treatment solution was applied, the surface of the intermediate transfer member was observed through use of an optical microscope, and was evaluated in accordance with the following criteria.

A: The treatment solution applied onto the intermediate transfer member wets and spreads over the intermediate transfer member so that 80% or more of the surface of the intermediate transfer member is coated with the treatment solution.

B: The treatment solution applied onto the intermediate transfer member is repelled so that less than 80% of the surface of the intermediate transfer member is coated with the treatment solution.

[Evaluation of Transferability of Image]

Black, cyan, magenta, and yellow inks were each prepared with the composition shown in Table 1 below.

TABLE 1

| | |
|---|---|
| The following pigments<br>Black: Carbon Black (produced by Mitsubishi Chemical Corporation: MCF88)<br>Cyan: Pigment Blue 15<br>Magenta: Pigment Red 7<br>Yellow: Pigment Yellow 74 | 3 parts |

TABLE 1-continued

| | |
|---|---|
| Styrene-acrylic acid-ethyl acrylate copolymer | 1 part |
| Glycerin | 10 parts |
| Ethylene glycol | 5 parts |
| Surfactant | 1 part |
| Acetylenol EH (produced by Kawaken Fine Chemicals Co., Ltd.) | |
| Ion exchanged water | 80 parts |

The above-mentioned treatment solution was applied onto the surface of the intermediate transfer member through use of the offset gravure roll in an application amount of about 5.0 g/m$^2$. Then, ink was applied through use of an ink jet recording apparatus (nozzle array density of 1,200 dpi, ejection amount of 4.8 pl, and drive frequency of 12 kHz) so that an intermediate image including mirror-inverted characters was formed on the intermediate transfer member on which the treatment solution was applied.

The intermediate image formed on the intermediate transfer member was dried by hot air, and then the intermediate transfer member was heated to 70° C. through use of a hot plate. The intermediate image formed on the intermediate transfer member and the recording medium were pressurized through use of the pressure roller so that the intermediate image was transferred onto the recording medium. As the recording medium, embossed paper "LEATHAC 66" (trade name) produced by Tokushu Tokai Paper Co., Ltd. was used.

The ink image transferred onto the recording medium was observed, and was evaluated in accordance with the following criteria. Results are shown in Table 2.

A: No transfer failure is observed in the intermediate image.

B: Transfer failure is observed in a part of the intermediate image, but the image transferred onto the recording medium is not problematic in practical use.

C: Serious transfer failure is observed in the intermediate image so that the image transferred onto the recording medium is problematic in practical use.

Examples 2 to 5

The intermediate transfer member was manufactured through the same procedure as that of Example 1 except that the film thickness and the material of the elastic layer and the dimensions of the protrusions were changed as shown in Table 2. Then, the manufactured intermediate transfer member was evaluated. Results are shown in Table 2.

In Examples 2 to 5, a material obtained by kneading silicone rubber "X-32-3094-2" (trade name) and a curing agent "CX-32-3094-2" (trade name) produced by Shin-Etsu Chemical Co., Ltd. at a mass ratio of 10:1 was used as the material for forming the first layer, whereas a material obtained by kneading silicone rubber "SIM-240" (trade name) and a curing agent "CAT-240" (trade name) produced by Shin-Etsu Chemical Co., Ltd. at a mass ratio of 10:1 was used as the material for forming the second layer.

TABLE 2

| | | Example 1 | Example 2 | Example 3 | Example 4 | Example 5 |
|---|---|---|---|---|---|---|
| First layer | Material | X-32-3094-2 | X-32-3094-2 | X-32-3094-2 | X-32-3094-2 | X-32-3094-2 |
| | Elastic modulus E1 | 12 MPa | 12 MPa | 12 MPa | 12 MPa | 12 MPa |
| | Film thickness | 100 μm | 150 μm | 100 μm | 100 μm | 0.1 μm |
| Second layer | Material | SIM-260 | SIM-240 | SIM-240 | SIM-240 | SIM-240 |
| | Elastic modulus E2 | 6.2 MPa | 1.7 MPa | 1.7 MPa | 1.7 MPa | 1.7 MPa |
| | Film thickness | 200 μm | 150 μm | 200 μm | 200 μm | 300 μm |
| | E1 − E2 | 5.8 | 10.3 | 10.3 | 10.3 | 10.3 |
| Shape of pattern of embossing roll (μm) | | W1 = 0.3<br>W2 = 0.2<br>H = 0.2 | W1 = 0.3<br>W2 = 0.2<br>H = 0.2 | W1 = 2.0<br>W2 = 1.0<br>H = 1.4 | W1 = 1.0<br>W2 = 1.0<br>H = 0.7 | W1 = 0.3<br>W2 = 0.2<br>H = 0.2 |
| Evaluation | Dimensions of pattern of transfer member | A | A | A | A | A |
| | Film thickness distribution | A | B | A | A | A |
| | State of applied treatment solution 5 g/m$^2$ | A | A | A | A | A |
| | State of applied treatment solution 1 g/m$^2$ | A | A | B | A | A |
| | State of applied treatment solution 0.3 g/m$^2$ | A | A | B | B | A |
| | Transferability of image | B | A | A | A | A |

Comparative Example 1

The intermediate transfer member was manufactured through the same procedure as that of Example 1 except that the second layer of the elastic layer was not formed. Then, the manufactured intermediate transfer member was evaluated. Results are shown in Table 3.

Comparative Examples 2 to 4

The intermediate transfer member was manufactured through the same procedure as that of Example 1 except that the film thickness and the material of the elastic layer were changed as shown in Table 3. Then, the manufactured intermediate transfer member was evaluated. Results are shown in Table 3.

When the treatment solution and the ink were repelled so that the intermediate image was not able to be formed, the transferability of the image was not evaluated.

TABLE 3

| | | Comparative Example 1 | Comparative Example 2 | Comparative Example 3 | Comparative Example 4 |
|---|---|---|---|---|---|
| First layer | Material | X-32-3094-2 | SIM-240 | SIM-240 | SIM-260 |
| | Elastic modulus E1 | 12 MPa | 1.7 MPa | 1.7 MPa | 6.2 MPa |
| | Film thickness | 300 μm | 100 μm | 100 μm | 100 μm |
| Second layer | Material | — | X-32-3094 | SIM-240 | SIM-240 |
| | Elastic modulus E2 | — | 12 MPa | 1.7 MPa | 1.7 MPa |
| | Film thickness | — | 200 μm | 200 μm | 200 μm |
| | E1 − E2 | — | −10.3 | 0 | 4.5 |
| Shape of pattern of embossing roll (μm) | | W1 = 0.3<br>W2 = 0.2<br>H = 0.2 | W1 = 0.3<br>W2 = 0.2<br>H = 0.2 | W1 = 0.3<br>W2 = 0.2<br>H = 0.2 | W1 = 0.3<br>W2 = 0.2<br>H = 0.2 |
| Evaluation | Dimensions of pattern of transfer member | A | C | C | C |
| | Film thickness distribution | C | A | A | A |
| | State of applied treatment solution 5 g/m$^2$ | A | B | B | B |
| | State of applied treatment solution 1 g/m$^2$ | A | B | B | B |
| | State of applied treatment solution 0.3 g/m$^2$ | A | B | B | B |
| | Transferability of image | C | — | — | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-121135, filed Jun. 16, 2015, which is hereby incorporated by reference herein in its entirety.

What is claimed is:

1. An intermediate transfer member for use in an image forming method, the image forming method comprising:

(1) applying a liquid for reducing fluidity of ink onto the intermediate transfer member;

(2) forming an intermediate image by applying the ink onto the intermediate transfer member on which the liquid for reducing the fluidity of the ink is applied; and (3) transferring the intermediate image onto a recording medium, the intermediate transfer member comprising:

a base; and an elastic layer formed on the base, the elastic layer comprising:

a first layer being an outermost layer and having a plurality of protrusions formed on a surface of the first layer; and a second layer located below the first layer, wherein an elastic modulus (E1) [MPa] of the first layer and an elastic modulus (E2) [MPa] of the second layer are such that (E1−E2)≥5 MPa, and wherein 8 MPa≤E1≤40 MPa.

2. The intermediate transfer member according to claim 1, wherein (E1−E2)≥10 MPa.

3. The intermediate transfer member according to claim 1, wherein a film thickness (T1) of the first layer is 100 μm or less.

4. The intermediate transfer member according to claim 1, wherein a height (H) of each of the plurality of protrusions is H≤1.0 μm, and wherein a base width (W1) of the each of the plurality of protrusions is W1≤1.0 μm.

5. The intermediate transfer member according to claim 4, wherein H≤0.3 μm and W1≤0.3 μm.

6. The intermediate transfer member according to claim 1, which has one of a belt shape and a drum shape.

7. An image forming method, comprising:

(1) applying a liquid for reducing fluidity of ink onto an intermediate transfer member;

(2) forming an intermediate image by applying the ink onto the intermediate transfer member on which the liquid for reducing the fluidity of the ink is applied; and (3) transferring the intermediate image onto a recording medium, wherein the intermediate transfer member comprises:

a base; and an elastic layer formed on the base, wherein the elastic layer comprises:

a first layer being an outermost layer and having a plurality of protrusions formed on a surface of the first layer; and a second layer located below the first layer, wherein an elastic modulus (E1) of the first layer and an elastic modulus (E2) of the second layer are such that (E1−E2)≥5 MPa, and wherein 8 MPa≤E1≤40 MPa.

8. A method of manufacturing an intermediate transfer member, the method comprising:

forming a second layer of an elastic layer by applying a material for forming the second layer of the elastic layer on a base and curing the applied material for forming the second layer; and forming a first layer of the elastic layer by applying a material for forming the first layer of the elastic layer on the second layer and forming a plurality of protrusions on a surface of the applied material for forming the first layer, wherein the intermediate transfer member comprises:

the base; and the elastic layer formed on the base, wherein the elastic layer comprises:

the first layer being an outermost layer and having the plurality of protrusions formed on a surface of the first layer; and the second layer located below the first layer, wherein an elastic modulus (E1) of the first layer and an elastic modulus (E2) of the second layer are such that (E1−E2)≥5 MPa, and wherein 8 MPa≤E1≤40 MPa.

9. The method according to claim 8, wherein the formation of the first layer comprises forming the plurality of protrusions by bringing a mold, which has a recessed shape conforming to the plurality of protrusions, into contact with the surface of the applied material for forming the first layer.

* * * * *